US005755191A

United States Patent [19]

Kottmann

[11] Patent Number: 5,755,191

[45] Date of Patent: May 26, 1998

[54] TWO-STROKE INTERNAL COMBUSTION ENGINE WITH CHARGING CYLINDER

[76] Inventor: Helmut Kottmann, Mörikestrasse 50, Steinheim, Germany, D-71711

[21] Appl. No.: 750,332

[22] PCT Filed: May 27, 1995

[86] PCT No.: PCT/DE95/00727

§ 371 Date: Nov. 26, 1996

§ 102(e) Date: Nov. 26, 1996

[87] PCT Pub. No.: WO95/33130

PCT Pub. Date: Dec. 7, 1995

[30] Foreign Application Priority Data

May 30, 1994 [DE] Germany ..... 44 18 844.7

[51] Int. Cl.[6] ..... F02B 25/12

[52] U.S. Cl. ..... 123/68; 123/70 R

[58] Field of Search ..... 123/65 R, 66, 123/68, 70 R, 72, 65 B, 51 B

[56] References Cited

U.S. PATENT DOCUMENTS

| | | | |
|---|---|---|---|
| 1,476,305 | 12/1923 | Toth | 123/51 B |
| 1,602,058 | 10/1926 | Violet | 123/51 B |
| 2,014,771 | 9/1935 | Mallory | 123/65 R |
| 2,048,243 | 7/1936 | Zoller | 123/51 B |
| 2,133,510 | 10/1938 | Hallett | 123/51 B |
| 2,164,451 | 7/1939 | Fast | 123/65 BA |
| 2,168,096 | 8/1939 | Ehrlich | 123/51 B |
| 2,234,918 | 3/1941 | Linthwaite | 123/65 BA |
| 2,295,120 | 9/1942 | Maw | 123/51 B |
| 2,342,900 | 2/1944 | Sandell | 123/51 B |
| 2,706,970 | 4/1955 | Rinne | 123/51 B |
| 4,079,705 | 3/1978 | Buchner | 123/53 B |
| 4,275,689 | 6/1981 | Ray | 123/65 A |
| 4,296,714 | 10/1981 | Buchner | 123/73 AA |

FOREIGN PATENT DOCUMENTS

| | | |
|---|---|---|
| 679457 | 8/1939 | Germany . |
| 2247147 | 6/1975 | Germany . |
| 2417185 | 10/1975 | Germany . |
| 58-172414 | 10/1983 | Japan . |
| 1495556 | 12/1977 | United Kingdom . |
| WO 90/08884 | 8/1990 | WIPO . |

*Primary Examiner*—David A. Okonsky
*Attorney, Agent, or Firm*—Collard & Roe, P.C.

[57] ABSTRACT

The invention concerns a two-stroke internal-combustion engine with a charging pump, an outlet channel controlled by the main piston being subjected to additional control by the charging-pump plunger. Circulation losses are minimized and a higher means working pressure is obtained by early mechanical closure of the outlet channel by means of the charging-pump plunger or by injecting a pulse of exhaust gases into the outlet channel in the direction opposite to the direction of flow or by injecting part of the intake charge through the outlet channel into the main cylinder. In addition, the formation of oxides of nitrogen is reduced by controlled exhaust gas retention at the combustion stage. The invention also allows a catalytic converter to be used if required, since an increase in the oxygen concentration owing to circulation losses in the outlet channel is avoided.

12 Claims, 5 Drawing Sheets

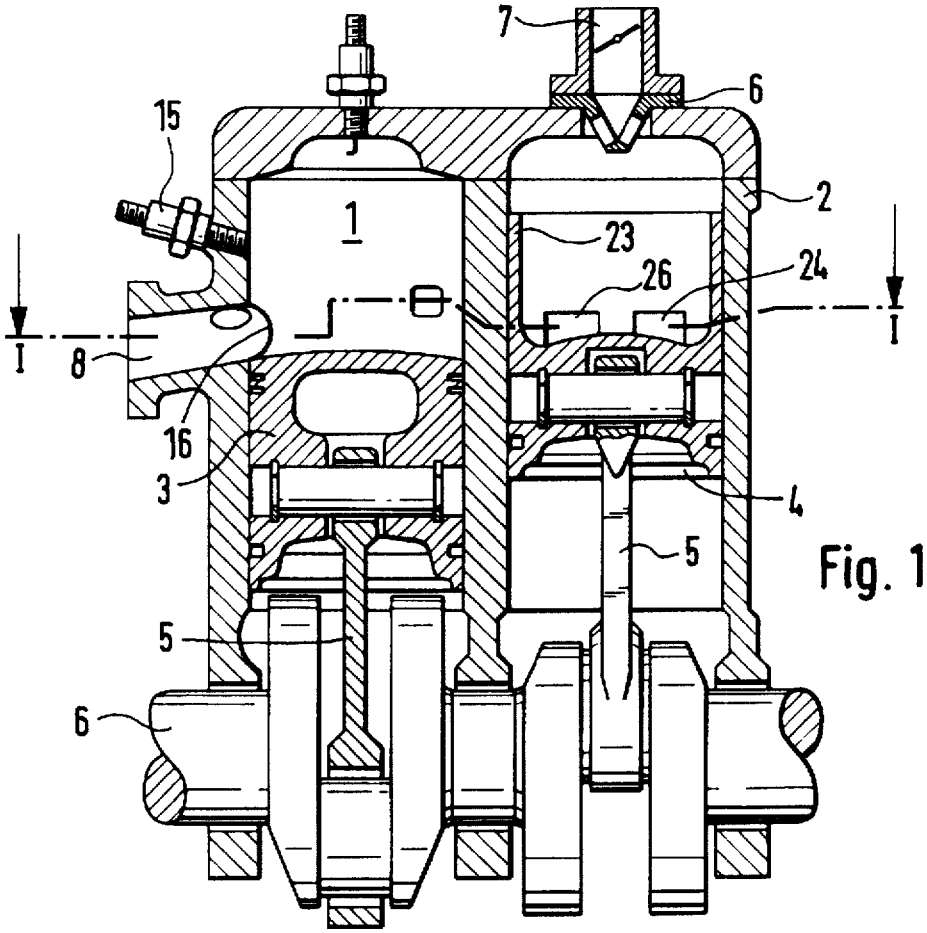
Fig. 1
Fig. 2
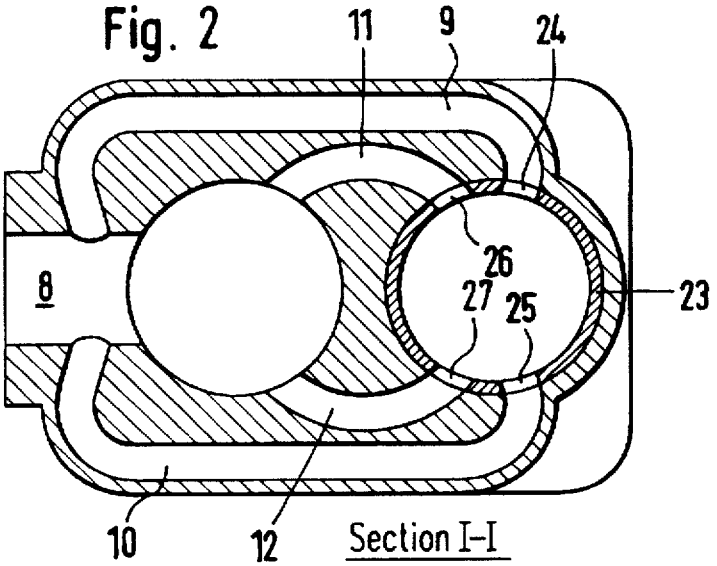
Section I-I
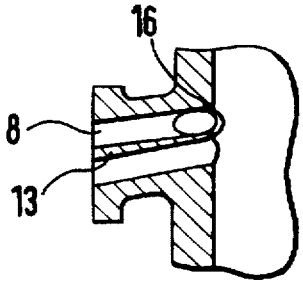
Fig. 3

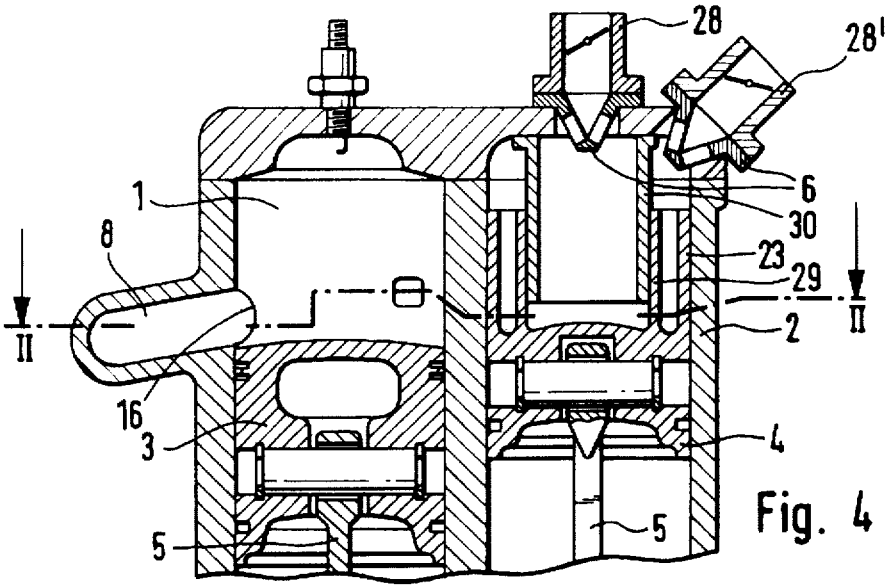
Fig. 4
Fig. 5
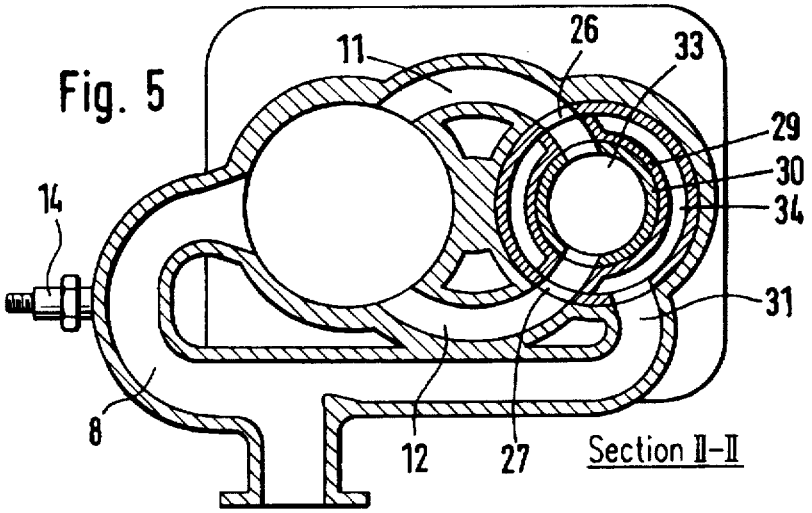
Fig. 6
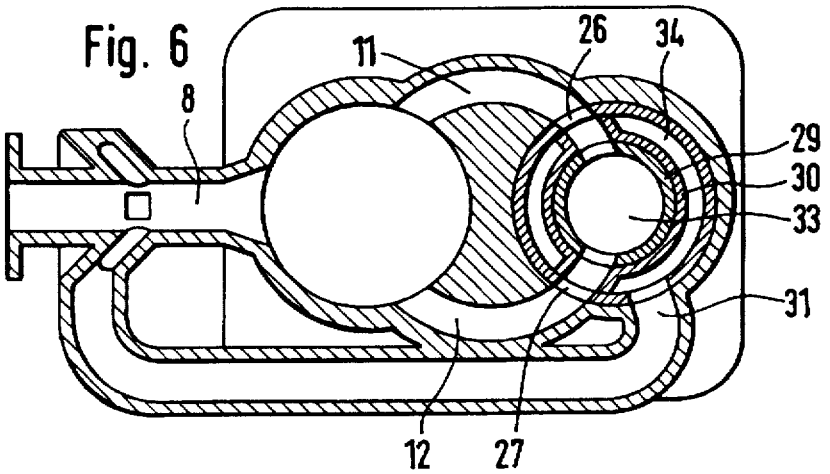

Section III–III

Section IV–IV

Section V-V

TWO-STROKE INTERNAL COMBUSTION ENGINE WITH CHARGING CYLINDER

The invention relates to a two-stroke, reciprocating-piston internal combustion engine with a charging cylinder arranged parallel with or inclined relative to the main cylinder, in which a single- or double-action pump piston is driven by a crankshaft and designed as a cylinder slide piston with overflow apertures, and the main cylinder has an outlet channel controlled by the main piston.

An internal combustion engine is known from U.S. Pat. No. 2,247,147 and No. 2,417,185, in which the outlet channel is, in the way known per se, exclusively opened and closed by the top edge of the main piston. For this reason, the control times for the opening and for the closing of the outlet channel are necessarily the same- and the control cross sections are the same as well, even though the control times and the control cross sections should be substantially lower for the closing of the outlet channel, so that fewer fresh gases can escape from the main cylinder into the outlet channel when the charge changes. WO 90/0884 A1 shows a two-stroke internal combustion engine with crankcase flushing, in which a connection duct is arranged from the crankcase to the outlet channel, through which fresh gas is conveyed and intended to penetrate the cylinder against the exhaust gas flow. Since the control of the connection duct is dependent on the position of the piston window, the connection duct is opened in part of the same period of time as the outlet slot. Therefore, a symmetric control diagram exists. The fresh gases thus flow into the outlet channel at an unfavorable point in time because the flow of exhaust gas still has a high intensity at such time. By the high vacuum prevailing at the orifice of the connection duct, the fresh gas charge is dragged along from the crankcase and necessarily mixed with the exhaust gas. The flushing pressure of a crankcase-flushed two-stroke engine, which pressure is known to be very low, leads to the fact that the flow of fresh gas is not capable of making its way against the direction of the flow of exhaust has, which has a larger volume.

It is known that in internal combustion engines with a single outlet slot control, as it is used with most two-stroke engines, a relatively large proportion of the intake charge escapes through the orifice of the outlet channel before said orifice is closed by the top edge of the piston at the end of the change in charge. This impairs the volumetric efficiency and limits the maximally attainable mean operating pressure of such an internal combustion engine to a relatively low level. A further drawback, which becomes increasingly more important, is the fact that circulation losses in the exhaust gas falsify the measurement of the oxygen content by means of a lambda probe in the exhaust gas duct, and make a catalytic conversion of the nitrogen oxides more difficult. Furthermore, the late closing of the outlet channel also impairs the quality of the mixture formation. So that no parts of the fuel can penetrate the outlet channel, the fuel or the fuel/air mixture has to be admitted into the main cylinder relatively late. Therefore, in an internal combustion engine in which the fuel is directly injected into the main cylinder, only short times are available for the preparation of the mixture until ignition time. In addition, there is the drawback that the turbulences of the charging air have subsided as well. This impairs the formation of the mixture especially at high numbers of revolution and thus the quality of the combustion. Heretofore, resonance exhaust systems have been used in order to counteract the occurrence of charging losses with a retrogressive exhaust gas vibration. This mode of operation, however, has little efficiency; it is limited to a very narrow band of numbers of revolution, and thus inadequate for an internal combustion engine that is expected to operate economically in all load and rpm-ranges.

The invention is based on the problem of eliminating said deficiencies. Without arranging any additional costly control elements such as valves or rotary roll slides, the objective is to prevent fresh charge from escaping from the main cylinder into the outlet channel, and to increase across a broad range of numbers of revolution the volumetric degree of efficiency and thereby the effective mean operating pressure. This applies to internal combustion engines operating according to both the Diesel-process and the Otto-process.

According to the invention, said problem is solved in that at least one connection duct, the latter being controlled independently of the main piston, is arranged between the charging-pump cylinder and the outlet channel, which duct is controlled by the charging-pump piston, and through which part of the charging air precompressed in the charging-pump cylinder is conveyed into the outlet channel, and through its orifice against the direction of outflow into the main cylinder while the main piston moves upwardly from its lower deadpoint and has not yet closed the orifice of the outlet channel. Or in that the space of the charging-pump cylinder is divided by separation walls in two chamber; and in that one of said two chambers conveys exhaust gas into the outlet channel through at least one connection duct, the latter being controlled independently of the main piston and being controlled by the charging-pump piston, while the main piston moves upwardly from its lower deadpoint and has not yet closed the outlet slot of the outlet channel; and in that the direction of inflow of said flow of exhaust gas into the outlet channel is opposite to the direction of outflow of the charge losses from the main cylinder. Or in that at least one outlet channel feeding into the charging-pump cylinder is arranged; and in that a duct arranged in the charging-pump piston connects the orifice of the outlet channel with the orifice of a duct discharging from the charging-pump cylinder when the main piston opens the outlet slot in the main cylinder; and in that the wall of the charging-pump piston closes the outlet slot in the charging-pump cylinder earlier than the main piston closes the outlet slot in the main cylinder. Useful developments of the invention are the subject matter of the dependent claims.

Exemplified embodiments of the subject matter of the invention are shown in the drawings.

FIGS. 1 and 2 snow an exemplified embodiment, in which two connection ducts are arranged between the charging-pump cylinder and the outlet channel.

FIG. 3 shows an exemplified embodiment, in which the outlet channel is divided by a wall and the connection ducts only feed into the top part.

FIGS. 4 and 5 show an exemplified embodiment, in which the charging-pump space is divided in two chambers, of which one conveys, for example exhaust gas into the outlet channel.

FIG. 6 shows a channel design as an alternative to the one shown in FIG. 5.

Figure 7:
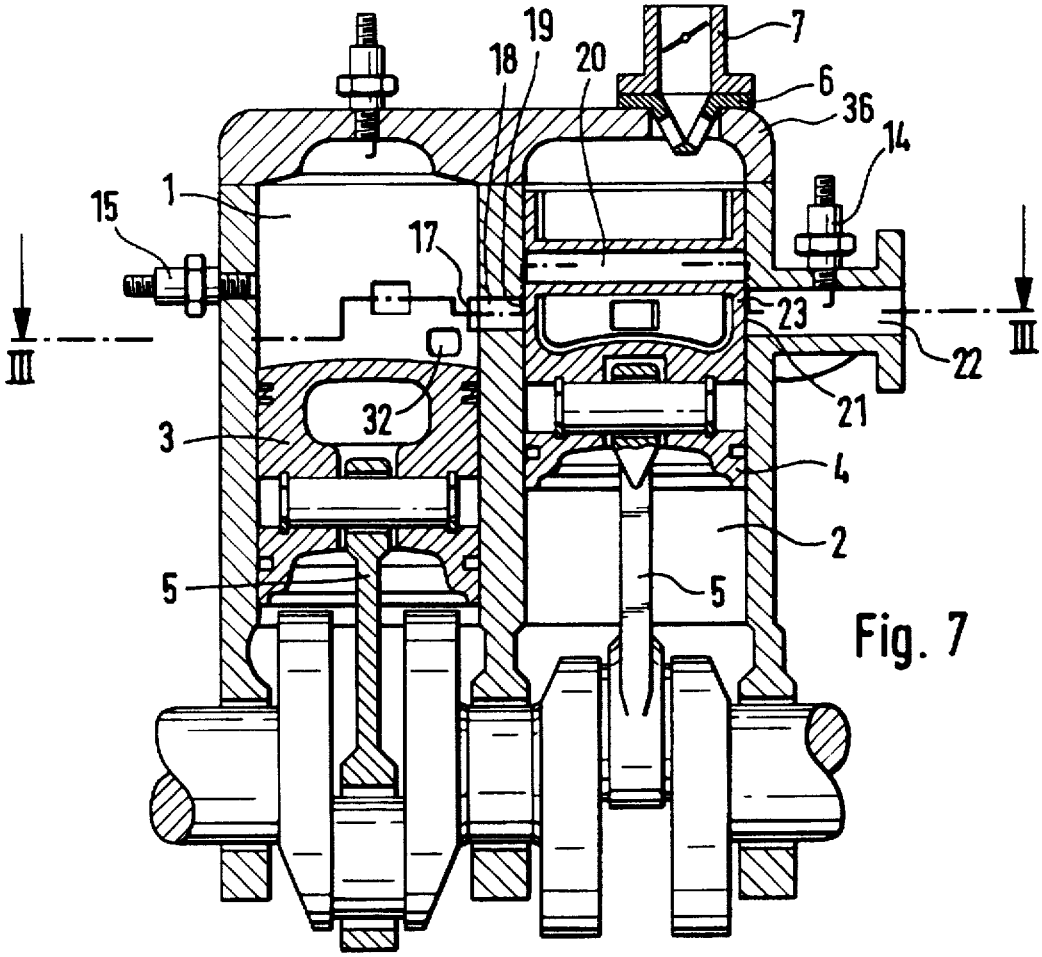
FIGS. 7 and 8 show an exemplified embodiment in which an outlet channel leads to the charging-pump cylinder and is additionally controlled by the charging-pump piston.

In the internal combustion engine with charging-pump cylinder shown in FIGS. 1 and 2, part of the intake charge is admitted into the main cylinder (1) through the outlet channel (8), whereas the other part is admitted into the main cylinder (1) in the usual way through direct overflow ducts (11 and 12). In this connection, the individual part quantities and also the time at which intake of such part quantities into the main cylinder (1) starts, are variable within a wide range by arranging the overflow apertures in the charging-pump piston. First, intake charge flows through the overflow ducts (11 and 12) into the main cylinder (1) and expels the residual gases through the outlet channel (8). After the major part of the residual gases has escaped through the outlet channel (8), the ducts (9 and 10) are released by the recesses (24 and 26) in the charging-pump piston, so that the remaining part of the intake charge flows through the outlet channel (8) and into the main cylinder (1). Such flow largely prevents intake charge from escaping from the main cylinder (1) and reduces the thermal load on the outlet channel (8).

FIG. 3 shows an exemplified embodiment in which the outlet channel (8) is divided by a wall (13), whereby the connection ducts (9 and 10) only feed into the top part of the outlet channel (8). In this way, the intensity of counterflow is increased, which prevents the intake charge from exiting from the main cylinder (1). Since the lower part of the outlet channel (8) is closed by the main piston (3) much earlier, counterflow is dispensed with in this part of the outlet channel (8).

FIGS. 4 and 5 show an exemplified embodiment in which exiting of flushing gases from the main cylinder (1) is counteracted by a pulsating exhaust gas counterflow introduced in the outlet channel (8). For this purpose, the space of the charging-pump cylinder (2) is divided in 2 chambers, of which one conveys the intake charge and the other the exhaust gas required for the counterflow. Both chambers (33 and 34) are controllable independently of each other by means of butterfly valves. Also, the compression can be different for the two chambers (33 and 34) as required. In this way, it is possible to achieve for each operating condition extensive optimization also for controlled exhaust gas retention. With this design, the oxygen content prevailing during combustion in the outlet channel (8) can be measured and controlled by a lambda probe (14) without falsification. Furthermore, this creates the precondition for catalytic conversion of the nitrogen oxides. If, through suitable exhaust gas retention, the formation of nitrogen oxides should be so low that no catalytic after-treatment is required for meeting the requirements, the chamber (33) also can convey air or another medium for the counterflow instead of exhaust gas, whereby the air is than available as secondary air for after-oxidizing the hydrocarbons and the carbon monoxide.

FIG. 6 shows an alternative channel design to FIG. 5, whereby the exhaust gas counterflow is introduced by way of a plurality of apertures along the circumference of the outlet channel.

Figure 8:
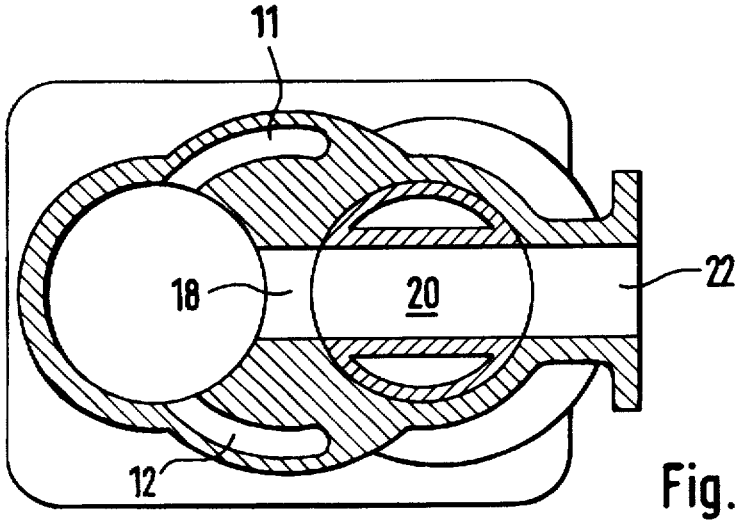

FIGS. 7 and 8 show an exemplified embodiment in which the outlet channel (8) leads to the charging-pump cylinder (2), and a duct (20) arranged in the charging-pump piston (4) connects said piston with the orifice (21) of a duct (22) discharging from the charging-pump cylinder (2) when the main piston (3) opens the outlet channel (18) in the main cylinder (1), so that the exhaust gases flow from the charging-pump cylinder (2) through the duct (22) in this way. Such outflow is stopped by the wall (23) of the charging-pump piston (4) before the main piston (3) closes the outlet channel (18). Thus only exhaust gases flow through the duct (22) without flushing gases, for which reason the lambda probe (14) is arranged in said duct. It may be advantageous to arranged in the main cylinder (1) additional outlet channels (e.g. 32) which are closed by the main piston (3) earlier than the outlet channel (18), and which not additionally controlled by the charging-pump piston (4).

Furthermore, FIGS. 7 and 8 show an advantageous arrangement of the fuel injection nozzle (15).

Figure 9:
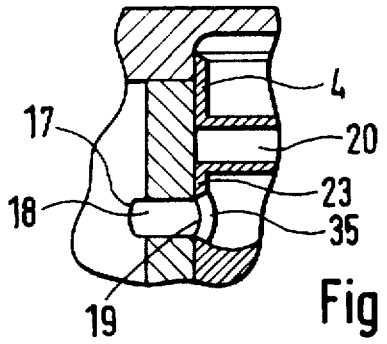
FIG. 9 shows a variation of FIG. 7, with an additional overflow aperture in the charging-pump piston.

FIG. 9 shows an exemplified embodiment in which the outlet channel (18) has at the same time the function of an intake channel. For this purpose, the wall (23) of the charging-pump piston is provided with another overflow aperture (35), which is completely open when the charging-pump piston (4) is in the top dead-point position. This causes precompressed fresh charge to flow through the outlet channel (18) into the main cylinder (1). Said flow promotes the preparation of the mixture especially when the fuel injection nozzle (15) is arranged oppositely in the wall of the main cylinder. Another design consists in that a fuel injection nozzle (15) is arranged in the cylinder head (36), with the injection jet of said nozzle impacting the wall of the connection duct (20). In this way, superior evaporation of the fuel is achieved, on the one hand, and on the other hand cooling of the wall temperature. Due to the division of the charging-pump cylinder (2) in 2 chambers, one of the latter can convey air via the overflow channels (11 and 12) and the other a fuel-air mixture—which is precompressed in said other chamber—through the overflow aperture (35) in the charging-pump piston (4), into the main cylinder (1)

Figure 10:
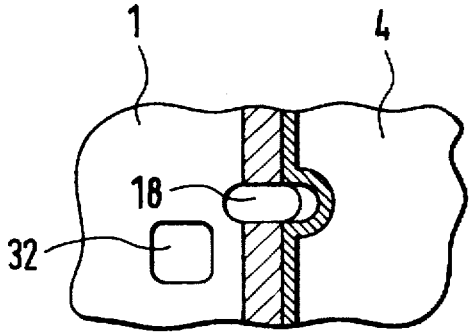
FIGS. 10 and 11 show another possibility for the channel design.
Figure 11:
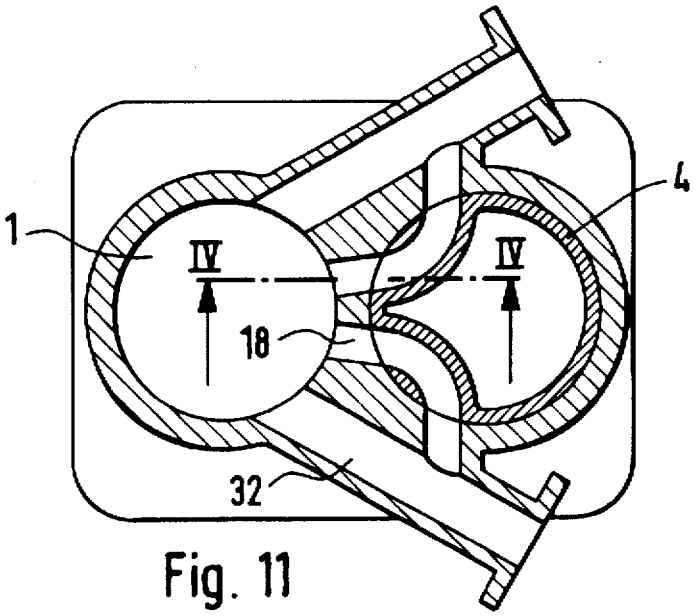

FIGS. 10 and 11 show an exemplified embodiment with a channel layout different from the one in FIGS. 7 and 8, whereby an outlet channel (18) additionally controlled by the charging-pump piston (4) feeds into an outlet channel (32) exclusively controlled by the main piston (3). In this embodiment, too, the outlet channel (18) can be used—as already described above and shown in FIG. 9—for the inflow of the fresh charge into the main cylinder (1)

Figure 12:
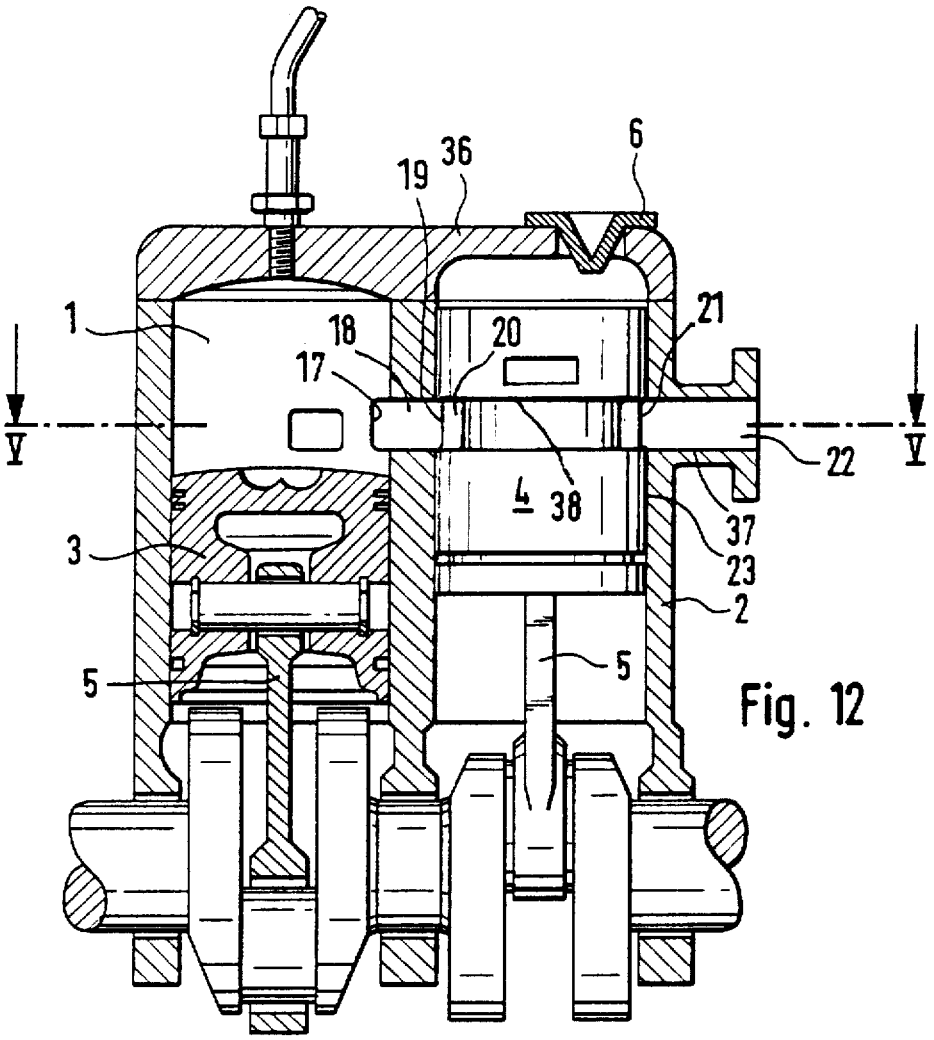
FIGS. 12 and 13 show a variation in which the charging-pump piston is fitted with a ring channel.
Figure 13:
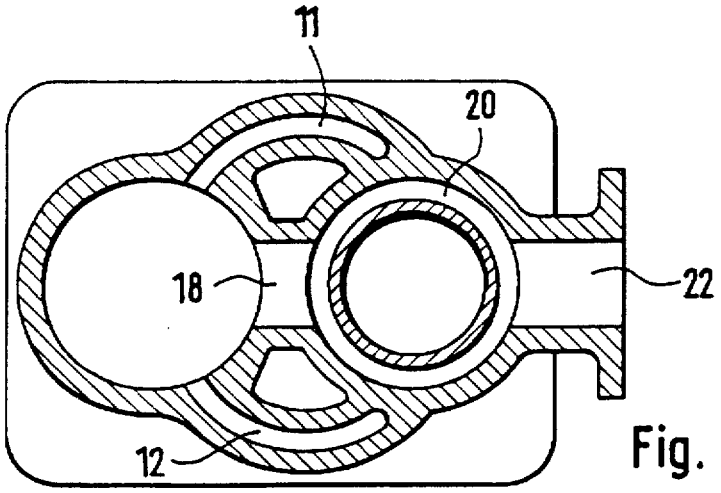

FIGS. 12 and 13 show an exemplified embodiment in which the charging-pump piston (4) is provided with an outwardly open ring channel, through which the exhaust gases flow to the duct (22) discharging from the charging-pump cylinder. The control edge (38) of the charging-pump piston (4) closes in this connection the bottom edge of the orifice (20) of the outlet channel (22) earlier than the main piston (3) closes the orifice (17) of the outlet channel (18) in the main cylinder (1).

Furthermore, in the figures, the reference numeral 5 denotes the piston rod and reference numeral 6 the crankshaft.

I claim:

1. Two-stroke, reciprocating-piston internal combustion engine with a charging-pump cylinder arranged parallel with or inclined relative to the main cylinder, in which the pump piston and the main piston are connected in terms of drive by a crankshaft, the pump piston is designed as a cylinder slide piston with overflow apertures, and the main cylinder has a piston-controlled outlet channel, characterized in that at least one connection duct (9), the latter being controlled independently of the main piston (3), is arranged between the charging-pump cylinder (2) and the outlet channel (8), said connection duct being controlled by the charging-pump piston (4) and conveying part of the charging air precompressed in the charging-pump cylinder (2) into the outlet channel (8) and through an outlet slot (16) against the outflow direction into the main cylinder (1), while the main piston (3) moves from its lower deadpoint upwardly and has not yet closed the outlet slot (16) of the outlet channel (8).

2. Internal combustion engine according to claim 1, characterized in that the overflow apertures (26 and 27) in the wall (23) of the charging-pump piston (4) open overflow ducts (11 and 12) earlier than overflow apertures (24 and 25) open the at least one connection duct (9 and 10).

3. Internal combustion engine according to claim 1, characterized in that the length of the at least one connection duct (9 and 10) is greater than the length of an overflow duct (11 and 12).

4. Internal combustion engine according to claim 1, characterized in that the height of the outlet channel (8) is divided by a wall (13), and that the at least one connection duct (9 and 10) only feed into the upper part of the outlet channel.

5. Internal combustion engine according to claim 1, characterized in that one or several outlet channel(s) (e.g. 32) is/are additionally arranged in the main cylinder (1), said channel(s) being closed by the main piston (3) in the main cylinder (1) earlier than the outlet channels (8 and 18), respectively.

6. Two-stroke, reciprocating-piston internal combustion engine with a charging-pump cylinder arranged parallel with or inclined relative to the main cylinder, in which the pump piston and the main piston are connected in terms of drive by a crankshaft and the pump piston is designed as a cylinder slide piston with overflow apertures, and the main cylinder has a piston-controlled outlet channel, characterized in that the space of the charging-pump cylinder (2) is divided by separation walls (29, 30) in two chambers; that through one of said two chambers (33, 34), exhaust gas is conveyed through at least one connection duct (31), the latter being controlled independently of the main piston and controlled by the charging-pump piston (4), into the outlet channel (8) while the main piston (3) moves from its lower deadpoint upwardly and has not yet closed an outlet slot (16) of the outlet channel (8); that the inflow direction of said flow of exhaust gas into the outlet channel (8) is opposite to the outflow direction of parts of the charge from the main cylinder (1); and that through the second chamber, charging air or a fuel/air mixture is conveyed through overflow ducts (11, 12) into the main cylinder (1).

7. Internal combustion engine according to claim 6, characterized in that precompression of the two chambers (33 and 34) can be different.

8. Internal combustion engine according to claim 6, characterized in that the division of the charging-pump space in two chambers by the separation walls (29 and 30) takes place before the overflow apertures (26 and 27) of the charging-pump piston (4) open the overflow ducts (11 and 12), and that only one short inlet pipe (28) with a valve (6) is arranged.

9. Two-stroke, reciprocating-piston internal combustion engine with a charging-pump cylinder arranged parallel with or inclined relative to the main cylinder, in which the pump piston and the main piston are connected in terms of drive by a crankshaft and the pump piston is designed as a cylinder slide piston with overflow apertures and the main cylinder has a piston-controlled outlet channel, characterized in that at least one outlet channel (18) feeding into the charging-pump cylinder (2) is arranged; that a duct (20) arranged in the charging-pump piston (4) connects an orifice (19) of the outlet channel (18) with an orifice (21) of a duct (22) discharging from the charging-pump cylinder (2) when the main piston (3) opens an outlet slot (17) of the outlet channel (18) in the main cylinder (1); that the wall (23) of the charging-pump piston (4) closes the orifice (19) of the outlet channel (18) in the charging-pump cylinder (2) earlier than the main piston (3) closes the outlet slot (17) of the outlet channel (18); and that the charging air or the fuel/air mixture is conveyed through the overflow ducts (11, 12) into the main cylinder.

10. Internal combustion engine according to claim 9, characterized in that at least one overflow aperture (35) is arranged in the wall (23) of the charging-pump piston (4), said overflow aperture connecting the space of the charging-pump cylinder (2) with the outlet channel (18) as soon as the connection of the outlet channel (18) with the duct (22) is interrupted, so that fresh gas flow from the charging-pump cylinder (2) through the outlet channel (18) into the main cylinder (1).

11. Internal combustion engine according to claim 9, characterized in that a fuel injection nozzle (15) is arranged in the wall of the main cylinder (1), the injection jet of said nozzle being directed at the outlet slot (17) of the outlet channel (18).

12. Internal combustion engine according to claim 9, characterized in that an injection nozzle is arranged in the cylinder head (86) of the charging cylinder, the fuel jet of said nozzle being directed at the wall of the duct (20) of the charging-pump piston (4).

* * * * *